US006904655B1

(12) United States Patent
Lima et al.

(10) Patent No.: US 6,904,655 B1
(45) Date of Patent: Jun. 14, 2005

(54) HELICAL DRIVE INSERTION AND EJECTION

(75) Inventors: David Lima, Los Altos, CA (US); Keith Jeffrey Hocker, Cupertino, CA (US); Mario David Bogdan, Los Gatos, CA (US); Tony Joseph Lilios, Palo Alto, CA (US)

(73) Assignee: Juniper Networks, Inc., Sunnyvale, CA (US)

( * ) Notice: Subject to any disclaimer, the term of this patent is extended or adjusted under 35 U.S.C. 154(b) by 253 days.

(21) Appl. No.: 09/940,261

(22) Filed: Aug. 27, 2001

(51) Int. Cl.[7] ..... B25B 27/14

(52) U.S. Cl. ..... 29/281.6; 29/758; 29/764; 29/278; 29/281

(58) Field of Search ..... 29/758, 764, 278, 29/281.1, 281.3, 281.6

(56) References Cited

U.S. PATENT DOCUMENTS 243,035 A * 6/1881 Geer ..... 99/515
4,615,274 A * 10/1986 Hoehn ..... 104/167
4,939,908 A * 7/1990 Ewing et al. ..... 62/139
5,557,998 A * 9/1996 Schwartz et al. ..... 83/875
6,213,487 B1 * 4/2001 Doroftei ..... 280/252
6,354,119 B1 * 3/2002 Molzer ..... 70/210

* cited by examiner

*Primary Examiner*—Richard Chang
(74) *Attorney, Agent, or Firm*—Shumaker & Sieffert, P.A.

(57) ABSTRACT

A helical drive system for seating and unseating a removable component, such as a printed circuit board, into a slot is described. The helical drive system includes a receptacle fixed to a housing proximate the slot. A handle and drive shaft are attached to the printed circuit board. The drive shaft has a helical groove that mates with a pin included in the receptacle. Rotation of the drive shaft pulls the printed circuit board into the slot and fully seats the printed circuit board. Rotation in the other direction unseats the printed circuit board. The helical groove has an enlarged entry that terminates in one or more points. This configuration facilitates the automatic alignment of the pin with the helical groove.

36 Claims, 6 Drawing Sheets

FIG. 2A
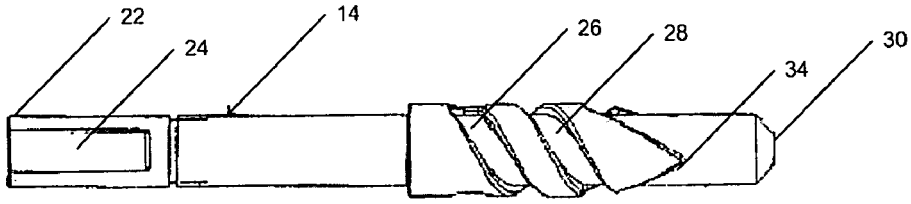
FIG. 2B
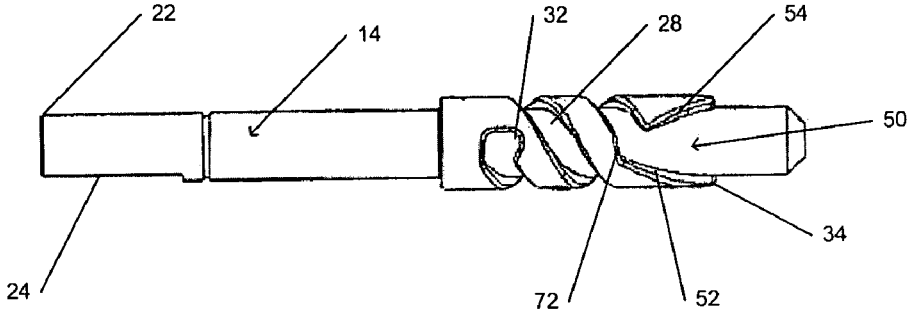
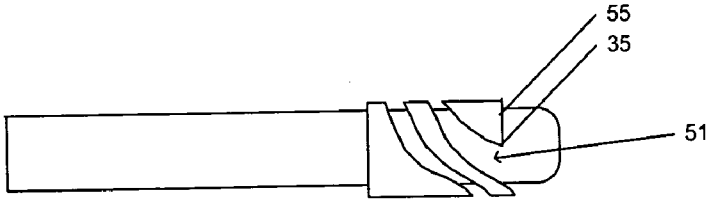
FIG. 2C

HELICAL DRIVE INSERTION AND EJECTION

TECHNICAL FIELD

The invention relates generally to coupling components and, more specifically, to the coupling of printed circuit boards and other components.

BACKGROUND

Various electrical devices and computing systems, such as network routers, utilize printed circuit boards or other removable modules. Printed circuit boards generally have one or more connecters that couple with a socket or receptacle. The connectors often include a plurality of discrete elements, such as pins or tabs. Similarly, the socket or receptacle will include a corresponding number of recesses to receive each of the pins or tabs.

Properly inserting a printed circuit board into an electrical device can often be a tedious and difficult task. Each individual pin or tab, for example, requires a certain amount of force to properly seat the printed circuit board into the socket. The total force required to seat the printed circuit board or other module includes the cumulative sum of the forces required to seat each individual pin or tab. Thus, as the number of pins or tabs increase, the force required to seat the printed circuit board likewise increases.

Furthermore, in order to assure a proper connection and to minimize any chance of damage, force should be evenly applied to the printed circuit board. That is, the uneven application of force along the printed circuit board may cause the circuit board to twist or otherwise deform and become only partially connected. Similarly, the extraction of printed circuit boards or other devices from such systems often requires a relatively large amount of force, typically about 75–80% of the force required for insertion, that must also be evenly applied across the printed circuit board.

The uniform application of force to a circuit board becomes more difficult as the amount of overall force required to properly seat the circuit board increases. To assist in the insertion and retraction of circuit boards and other devices, some systems provide various mechanical aids. Conventional mechanical aids include, for example, incorporating one or more levers, or one or more threaded members, such as alignment screws. The threaded members typically attach to the circuit board and align with a threaded connector coupled with the system.

The alignment of a threaded member with a threaded connector, however, can itself be tedious and difficult. Many conventional systems make use of multiple screws that must turn in relative synchronicity in order to apply uniform force. Hence, two (or more) tools, such as screwdrivers, must be used simultaneously, or each individual threaded member must be actuated on an alternating basis in relatively small increments. Additionally problems associated with these mechanical aids are the practical limits of the amount of force they can apply, the difficulty in manipulating these aides, the difficulty in aligning the aides, placing relatively large aides in small spaces, and properly shielding the system to prevent electromagnetic interference (EMI). The same mechanical aids are often used for both insertion and extraction and may have the same problems and drawbacks in either case.

SUMMARY

In general, the invention relates to a device for assisting in the insertion and extraction of printed circuit boards or other components from a device or system such as a network router. The device, referred to herein as a helical drive insertion and extraction device, may include two general components: a mobile component typically coupled with the printed circuit board or other movable component, and a fixed component typically coupled with the system to which the printed circuit board or other component is being inserted.

In particular, the mobile component includes a drive shaft having one or more helical groves that have relatively large points of entry to facilitate the automatic alignment of the drive shaft with the fixed component. The fixed component includes one or more pins that engage each of the helical grooves on the drive shaft. A handle mechanism is coupled with the drive shaft and is sized to fit within the available space while providing a high level of comfort and accessibility to an operator. A spring within the mobile component compresses as the pins near the end of the helical grooves and moves the pin into a detent and provides positive tactile feedback to the operator to indicate the completion of the insertion process.

In this manner, the helical drive insertion and extraction device delivers tremendous mechanical advantage while facilitating ease of use. The operator can, for example, fully seat the printed circuit board or other component with a single rotation of the handle. This single turn requires a small amount of torque, such as 5 inch/lbs to rotate, but can cause the device to deliver over 100 lbs of linear force in the seating/unseating direction. The amount of linear force developed, the linear distance traveled and the number of rotations of the handle can all be varied and are determined by the inclination angle of the helical grooves as well as the length and diameter of the drive shaft. Thus, low levels of torque deliver high levels of linear force. In addition, limited rotations of the handle accomplish the delivery of such forces. For example, 90°, 180°, 270°, 360° or any other degree of rotation sufficiently delivers the appropriate amount of force.

Generally, relatively small circuit boards or components require only a single helical drive insertion and extraction device. For larger circuit boards or components, it may be advantageous to utilize two or more helical drive insertion and extraction devices, usually positioned at opposite ends of the printed circuit board. Because of the structure of the helical grooves, the device self aligns with the pin(s) provided on the fixed component. A single turn of the handle(s) fully seats the component. Where two helical drive insertion and extraction devices are utilized, an operator can easily turn the handles simultaneously by hand so that force is applied evenly across the printed circuit board.

In one embodiment, the invention provides a router having a router housing. A system board is coupled with the router housing and includes a slot configured to receive a removable component. A receptacle assembly is coupled with the housing and includes a throughbore and a pin located within the throughbore. A handle is rotatably coupled with the removable component. A drive shaft is coupled with the handle and includes a first helical groove configured to cooperate with the pin. Rotation of the handle causes the drive shaft to rotate and the pin to travel along the helical groove that causes the removable component to move relative to the system board.

In another embodiment, a threaded member positioned within the handle of the helical drive insertion and extraction device provides such a locking mechanism that prevents unauthorized access to, or removal of, the printed circuit boards or other components from the system. When a printed circuit board is fully and properly seated, the threaded member in the handle aligns with a threaded connector in the fixed component and engages the threaded connector. In this fashion, an operator must engage the threaded member with a suitable tool to access the printed circuit board.

In another embodiment, the drive shaft has a first helical groove entry having a width that is greater than the width of the first helical groove, wherein at least a portion of the first helical groove entry is defined by a first inclined entry guide.

In another embodiment the drive shaft has a second helical groove and a second helical groove entry that includes a second groove point. A second inclined entry guide defines a portion of the second helical groove entry.

In another embodiment, a first detent forms a terminus of the first helical groove and is configured to receive the pin.

In another embodiment, the present invention includes a drive shaft having a proximal end and a distal end with a first helical groove disposed along the distal end, wherein the first helical groove includes a first enlarged entry. A handle is coupled to the proximal end of the drive shaft. A receptacle assembly has a first throughbore and a pin disposed within the through bore wherein the throughbore is configured to receive the distal end of the drive shaft and automatically align the pin with the first helical groove so that rotation of the handle causes rotation of the drive shaft which causes the pin to travel along the first helical groove. Rotation of the drive shaft in a first direction causes the proximal end to move towards the receptacle assembly and rotation in a second direction causes the proximal end to move away from the receptacle assembly.

The details of one or more embodiments of the invention are set forth in the accompanying drawings and the description below. Other features, objects, and advantages of the invention will be apparent from the description and drawings, and from the claims.

BRIEF DESCRIPTION OF DRAWINGS

FIG. 2A is a side elevational view of a drive shaft from the example helical insertion and extraction device.

FIG. 2B is a top elevational view of a drive shaft from the example helical insertion and extraction device.

FIG. 2C is a side elevational view of a drive shaft on another example helical insertion and extraction device.

DETAILED DESCRIPTION

Figure 1:
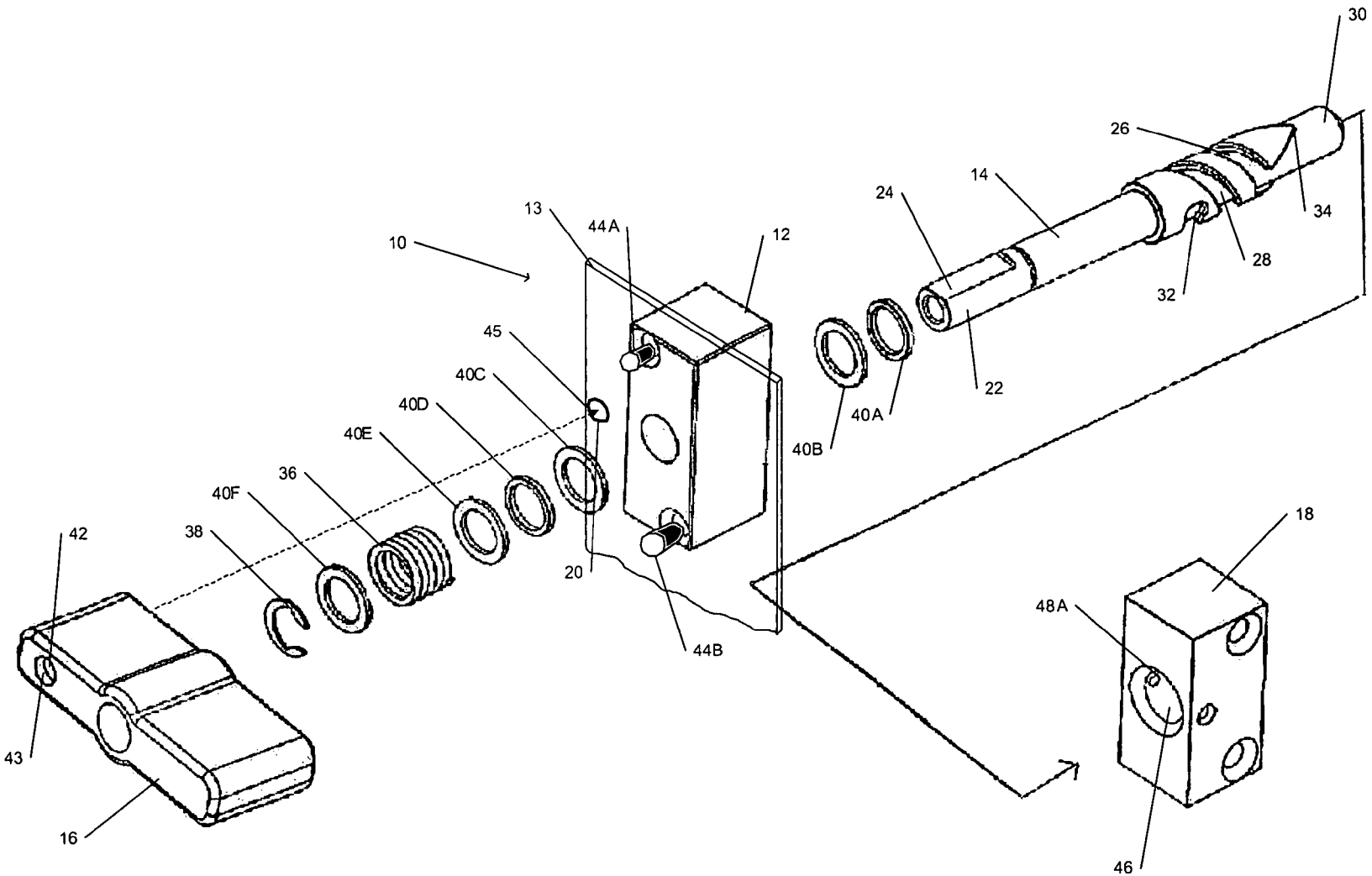
FIG. 1 is an exploded perspective assembly view of an example helical insertion and extraction device.

FIG. 1 is an exploded perspective assembly view of a helical insertion and extraction device, referred to as helical device 10, that assists in the insertion and extraction of printed circuit boards or other components from a device or system such as a network router. In general, helical device 10 includes a moveable component formed by housing 12, a drive shaft 14 and a handle 16, as well as a fixed component formed by receptacle assembly 18. An operator typically interacts with handle 16 to insert or extract a printed circuit board assembly 13 or other components from a system to which receptacle assembly 18 is affixed.

In particular, drive shaft 14 passes through shaft hole 20 and includes a proximal end 22 having a flattened portion 24 that engages with handle 16 so that rotation of handle 16 causes rotation of drive shaft 14. In response to rotation of handle 16, drive shaft 14 selectively engages receptacle assembly 18. A first helical groove 26 and a second helical groove 28 are located near a distal end 30 of drive shaft 14. First groove point 34 partially defines the entry into first helical groove 26, which terminates in a detent 32.

Proximal end 22 passes through washers 40A, 40B and shaft hole 20. A variety of washers 40C, 40D, 40E, 40F may be placed on proximal end 22. Compression spring 36 is placed over proximal end 22 between handle 16 and housing 12, and allows drive shaft 14 a limited amount of linear movement with respect to housing 12. A retaining clip 38 secures the various components into place as it is placed onto proximal end 22.

Distal end 30 selectively enters and passes through throughbore 46. First pin 48A engages first or second helical groove 26, 28. Thus, assuming receptacle assembly 18 is held stationary, drive shaft 14 must rotate in order for first pin 48A to follow first or second helical groove 26, 28.

Housing 12 may also include one or more mounting holes to receive threaded connectors 44A, 44B, thereby fixing housing 12 to assembly 13. Handle 16 may include one or more threaded members 42, located and rotatable within a throughbore 43 within handle 42. Threaded member 42 selectively engages threaded connector 45, thus securing handle 16 relative to assembly 13. Threaded member 42 can be positioned so that it only engages threaded connector 45 when handle 16 is properly oriented, thereby assuring proper positioning of handle 16 relative to housing 12 during operation of helical device 10.

FIG. 2A is a side elevational view of drive shaft 14, while FIG. 2B is a top elevational view of drive shaft 14 rotated 90° from the position illustrated in FIG. 2A. Helical device 10 gains substantial mechanical advantage during its operation because of the configuration of drive shaft 14. That is, a relatively small rotational force applied to handle 16 translates into a relatively large amount of linear force between drive shaft 14 and receptacle assembly 18. First and second helical grooves 26, 28 provide this mechanical advantage, which is a function of the angle of inclination of the grooves 26, 28, i.e., the angle at which grooves 26, 28 traverse shaft 14. For example, the mechanical advantage achieved by device 10 increases as the angle of inclination approaches 90° relative to shaft 14. Similarly, the mechanical advantage decreases as the angle of inclination approaches horizontal, although a greater linear distance of travel is achieved.

A single helical groove or more helical grooves could also be utilized. To facilitate the automatic alignment of helical grooves 26, 26 with pins 48A, 48B (FIG. 3), grooves 26, 28 begin as relatively large gaps that terminate in relatively tapered points. For example, first groove point 34 forms a portion of first helical groove 26 and second helical groove 28. In particular, first groove point 34 forms a small stubbing surface to readily deflect pins 48A, 48B into one of the helical grooves 26, 28.

FIG. 2B more clearly illustrates the widened structure of first helical groove entry 50 which transforms into first helical groove 26. As illustrated, first and second helical groove points 34, 56 form the upper and lower (as illustrated) boundaries of entry 50. Groove points 34, 56 taper towards each other along first and second inclined entry guides 52, 54 which eventually channel into first helical groove 26. Thus, first entry 50 automatically guides one of pins 48A or 48B (FIG. 3) into first helical groove 26. Alternatively, a second entry (not separately shown) on the opposite side of drive shaft 14 guide pin 48 into the second helical groove 28. This occurs either because of random alignment or because groove point 34, 56 deflects one of pins 48A or 48B. In other words, insertion of drive shaft 14 into receptacle assembly 18 results in the automatic alignment of pins 48 with grooves 26, 28 so that rotation can begin immediately. Once within first helical groove entry 50, rotation of drive shaft 14 causes pin 48 to travel along first helical groove 26.

Eventually, as drive shaft 14 is rotated, pin 48 reaches first detent 32. As this occurs, housing 12 and handle 42 compress spring 36 (FIG. 1) somewhat. Thus, as pin 48 reaches the end of first helical groove 26, compression spring 36 expands and forces pin 48 into first detent 32. This motion produces a tactile sensation that is perceivable by the operator. Rotation of drive shaft 14 in the opposite direction easily overcomes the biasing of compression spring 36, thus causing pin 48 to leave detent 32 and travel along first helical groove 26.

FIG. 2C is a side elevational view of another embodiment for drive shaft 14. In particular, drive shaft 14 may comprise a single groove point 35 forming a larger stubbing surface 55 and a smaller opening 51 for receiving pins 48A, B.

Figure 3:
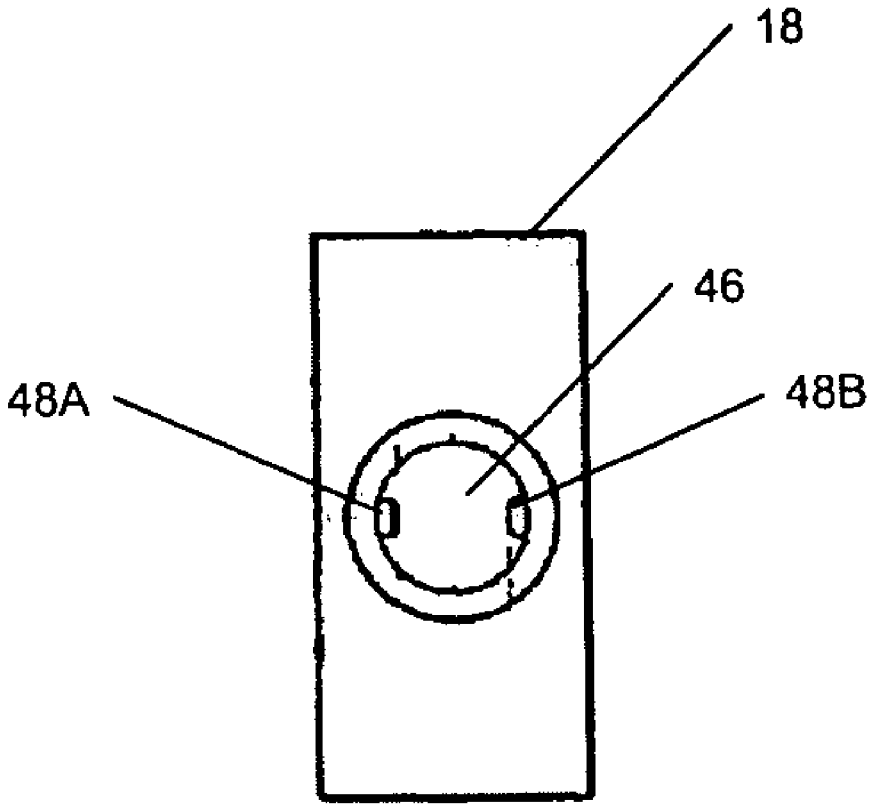
FIG. 3 is a front elevational view of a receptacle assembly of the example helical insertion and extraction device.

FIG. 3 is a front elevational view of receptacle assembly 18. Located within throughbore 46 are one or more pins 48A, 48B (collectively, pins 48). Pins 48 may be provided for helical grooves 26, 28 on drive shaft 14. In this embodiment, two helical grooves and two pins 48 are utilized. Of course, fewer pins 48 than grooves could be provided. Also, pins 48 may be any size or shape for engaging groves 26, 28. Receptacle assembly 18 may be attached to an object, such as an electrical device or computing system, and is referred to herein as the fixed component. Threaded connectors (or any other connecting device) may couple receptacle assembly 18 to the object. Alternatively, receptacle assembly 18 may be formed integrally with the object.

Figure 4:
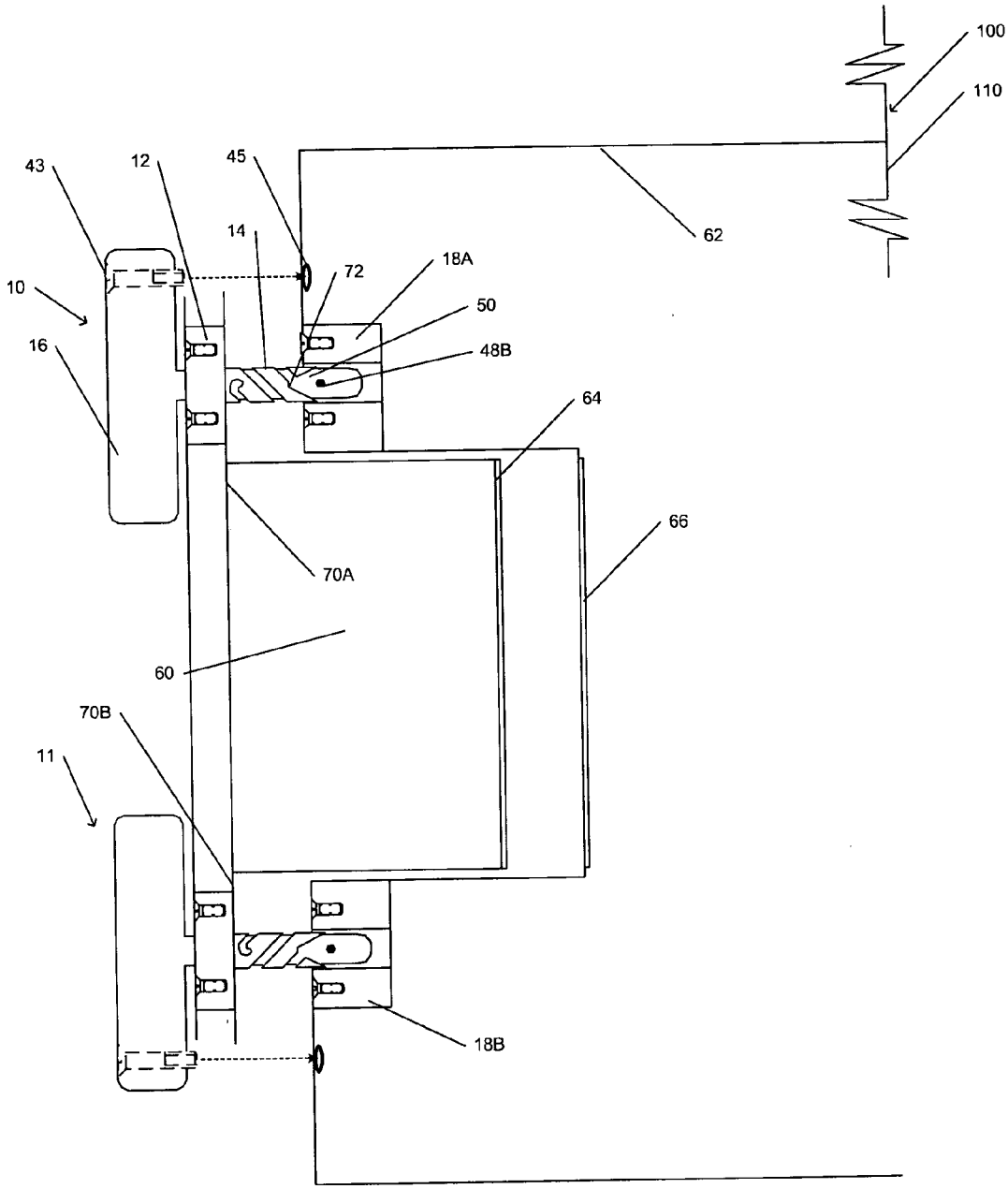
FIG. 4 is side elevational schematic illustration of an example helical insertion and extraction device coupled with a printed circuit board prior to insertion into a system.

FIG. 4 is side elevational schematic illustration of first and second helical devices 10, 11 coupled with a printed circuit board (PCB) 60 prior to insertion into a system board 62. System board 62 may be, for example, mounted within a network router 100 having a router housing 110. PCB 60 includes some type of connector, schematically illustrated as pins 64 that mate with sockets 66 on system board 62 when an appropriate amount of force is applied to PCB 60. A pair of plates or tabs 70A, 70B extend from PCB 60 for securing the mobile portions of first and second helical devices 10,11 respectively. Receptacle assemblies 18A, 18B are coupled with a system containing board 62 and sockets 66.

For insertion, PCB 60 is generally aligned as illustrated in FIG. 4 and moves in a linear direction from left to right (as illustrated). As this occurs, drive shaft 14 facilitates the entry of pin 48B into first helical groove entry 50. When positioned such that first or second groove point 34, 54 (FIG. 2B) align with and abut pin 48B, the linear motion combined with the inclined plane of entry 50 facilitate proper alignment. In some cases, a minimal rotation of handle 16 may be useful to align entry with the pins, but this is typically not necessary because of the shape of entry 50. Once entry 50 is positioned as illustrated, further linear movement (from left to right) occurs until pin 48B abuts a transition portion 72 of first helical groove 26. Transition portion 72 transforms first inclined entry guide 52 into first helical groove 26. In the illustrated embodiment, this alignment may be performed substantially simultaneously for first and second helical devices 10, 11.

When the operator rotates handle 16 clockwise, drive shaft 14 rotates, causing pin 48B to follow first helical groove 26. Simply pushing PCB 60 will also cause pin 48B to follow first behind groove 26. Although handle 16 is illustrated as centered on drive shaft 14, handle 16 could also be offset. This would allow handle 16 to function in environments where space is limited and would allow an operator to clearly determine when handle 16 is properly positioned. As handle 16 rotates, drive shaft 14 (and hence PCB 60) moves towards system board 62. As pin 48B nears the end of first helical groove 26, compression spring 36 (FIG. 1) compresses somewhat. When able, compression spring 36 expands which causes pin 48B to enter detent 32 (FIG. 2B). This provides a snap or click that is perceivable by the operator.

Figure 5:
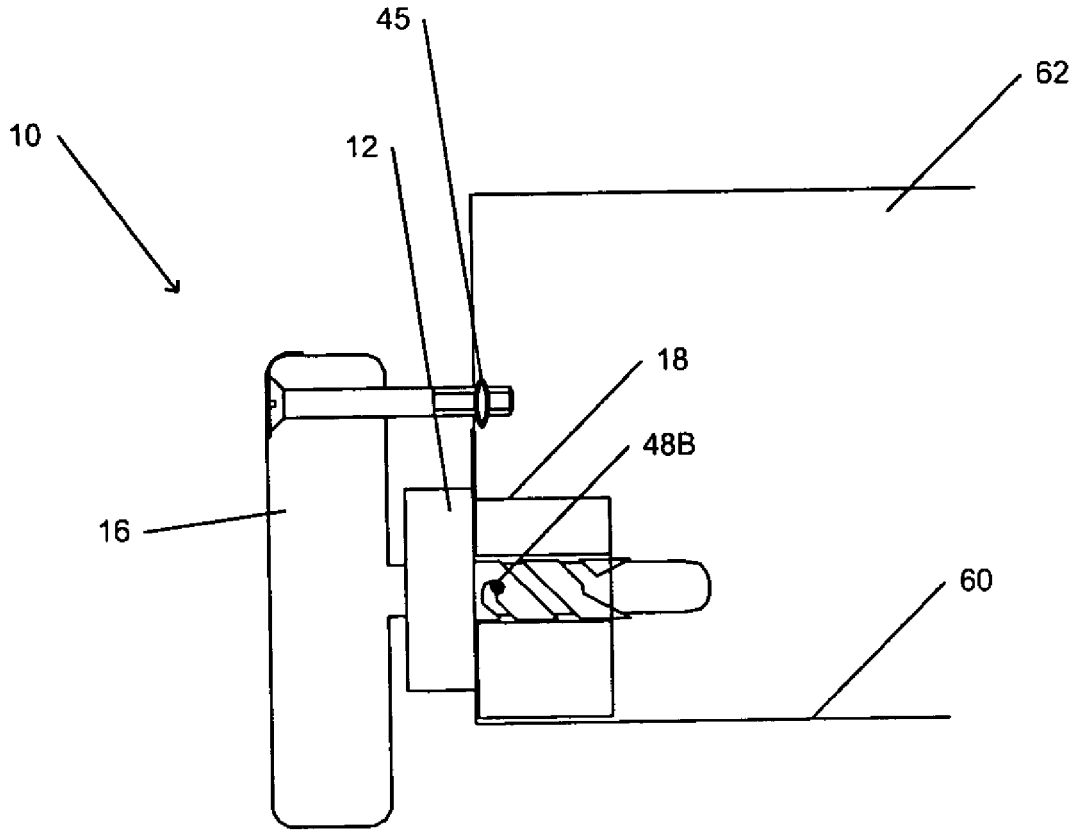
FIG. 5 is side elevational schematic illustration of an example helical insertion and extraction device coupled with a printed circuit board prior after insertion into a system.

FIG. 5 is a side elevational schematic view of helical device 10 when an operator has fully inserted PCB 60 into socket 66. In this position, PCB 60 is snuggly mated with system board 62 and EMI leakage is reduced because no additional areas of system board 62 need be exposed. To remove PCB 60, an operator reverses the process and turns handle 16 counter clockwise until PCB 60 separates from system board 62. With either insertion or extraction, it may be desirable to turn handles 16 of both helical devices 10, 11 simultaneously.

The configuration of helical device 10 offers various advantages. For example, a relatively small amount of torque or rotational force applied to handle 16 delivers a relatively large amount of linear force to insert or extract PCB 60. In the illustrated embodiment, a single 360° rotation of handle 16 fully seats or unseats PCB 60. Rotation of handle 16 requires about five inch/lbs of torque to develop over 100 pounds of linear force. Of course, the required amount of rotation of handle 16, the force required to rotate handle 16 and the linear force developed can all be varied using alternative embodiments. The inclination of helical grooves 26, 28 can be varied to make the travel of drive shaft 14 more or less rapid as well as varying the distance of travel achieved.

No additional tools are required to insert/extract PCB 60 into system board 62. That is, helical device 10 provides the operator with all that is required to quickly and easily perform insertion and extraction. However, in some contexts it may be desirable to provide a locking mechanism so that PCB 60 is not accessed by unauthorized personal. To achieve this, handle 16 locks relative to assembly 13. As explained with reference to FIG. 1, locking device 42 is provided in handle 16 and connects with threaded connector 45. Locking device 42 may simply be a screw or bolt that only requires the use of a screwdriver or similar common tool. In other words, locking device 42 makes it necessary to use some tool to remove PCB 60, though the actual extraction does not require a tool beyond helical device 10. Alternatively, locking device 42 could be configured to require a key or other unique access tool, depending upon the level of security desired.

Thus, within the space already provided for PCB 60, helical device 10 offers a fast and easy way to insert/extract PCB 60 quickly and efficiently. High amounts of force can be achieved, no tools are required, alignment is easy and automatic, force is evenly applied, EMI integrity is maintained, and only a small amount of rotation is required.

Figure 6:
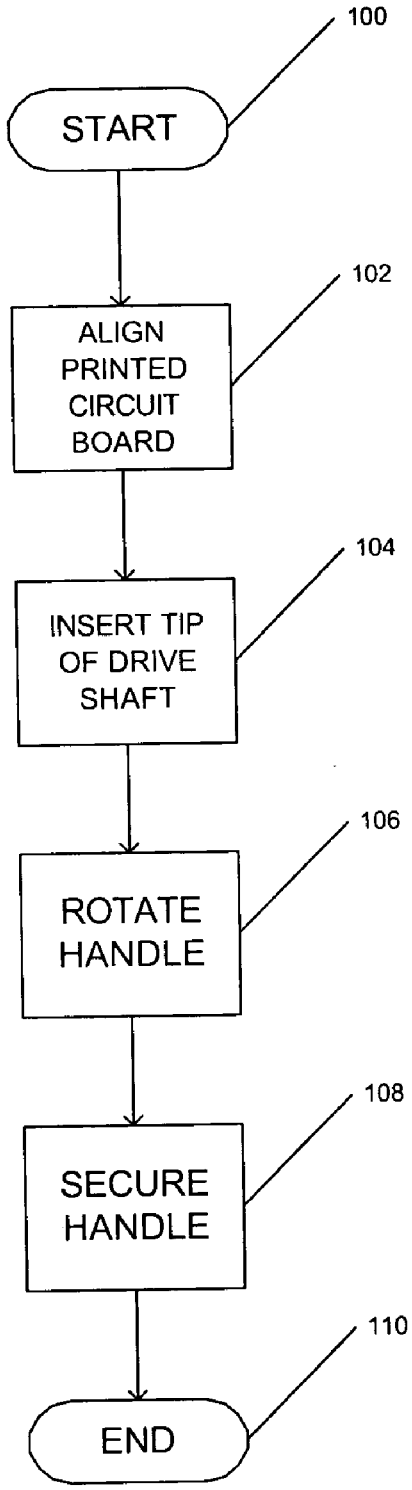
FIG. 6 is a flowchart illustrating the process of using the helical insertion and extraction device.

FIG. 6 is a flow chart illustrating the process of connecting a printed circuit board to a system board with helical device 10. The process starts when an operator aligns a printed circuit board with a corresponding system board (102). Then, the operator inserts the tip of the each of the drive shafts 14 into receptacle assembly 18 (104) so that helical grooves 26 and 28 on drive shaft 14 automatically aligns with pin 48 located within receptacle assembly 18. Next, the operator rotates handle 16 (106) causing pin 48 to travel along either helical groove 26 or 28 so that the printed circuit board assembly 13 moves towards the system board. After the printed circuit board is connected, the operator then optionally secures handle 16 (108) so that unauthorized access is hindered and the process is complete (110). To remove the printed circuit board assembly 13, the operator reverses the process illustrated in FIG. 4.

A number of embodiments of the present invention have been described. Nevertheless, it will be understood that various modifications may be made without departing from the spirit and scope of the invention. Accordingly, other embodiments are within the scope of the following claims. For example, the number of helical devices utilized with a given printed circuit board may be varied from one to many. The rotation of the handle required to full insert or extract the board can vary from a small fraction of a rotation to one or more full rotations. The number and angles of the helical grooves may be varied. Finally, the present invention may be used on any number of objects that need to be inserted or extracted and are not limited to printed circuit boards.

What is claimed is:

1. A system comprising:

a removable electrical component;

a housing to receive the removable electrical component;

an assembly coupled with the housing, the assembly including a pin; and a rotatable drive shaft coupled with the removable electrical component to engage the assembly, wherein the drive shaft includes a first helical groove to receive the pin and guide the pin along the shaft.

2. The system of claim 1 further including a handle coupled with the removable electrical component, wherein rotation of the handle drives the shaft relative to the pin to move the removable electrical component relative to the housing.

3. The system of claim 1, wherein the drive shaft further comprises a first helical groove entry having a width greater than a width of the first helical groove, wherein at least a portion of the first helical groove entry is defined by a first inclined entry guide.

4. The system of claim 3, wherein the first inclined entry guide includes a first groove point disposed at a first end of the first inclined entry guide.

5. The system of claim 3, further comprising a transition portion disposed between the first inclined entry guide and the first helical groove.

6. The system of claim 1, wherein the drive shaft includes a second helical groove having a second helical groove entry including a second groove point, wherein at least a portion of the second helical groove entry is defined by a second inclined entry guide.

7. The system of claim 1, further comprising a first detent forming a terminus of the first helical groove and configured to receive the pin.

8. The system of claim 7, further comprising a compression spring arranged so that as the pin travels along a portion of the first helical groove the compression spring is compressed and causes the pin to enter the first detent.

9. The system of claim 1, wherein the removable electrical component is a printed circuit board and the printed circuit board is fully inserted and or extracted through rotation of the drive shaft.

10. The system of claim 1, further comprising a locking device configured to prevent rotation of the handle relative to the removable electrical component when the locking device is engaged.

11. The system of claim 10, wherein the locking device further comprises:

a threaded member disposed within the handle; and a threaded connector disposed within a housing coupled with the removable electrical component.

12. A device for inserting and extracting a removable electrical component comprising:

a drive shaft fixed to the removable electrical component, wherein the drive shaft has a proximal end and a distal end with a first helical groove disposed along the distal end, and wherein the first helical groove includes a first enlarged entry;

a handle coupled to the proximal end of the drive shaft; and a receptacle assembly for mounting to a housing, wherein the receptacle assembly has a first throughbore and a pin disposed within the throughbore, wherein the throughbore receives the distal end of the drive shaft and the drive shaft aligns the pin with the first helical groove so that rotation of the handle causes rotation of the drive shaft which causes the pin to travel along the first helical groove, wherein rotation of the drive shaft in a first direction causes the removable electrical component to move towards the receptacle assembly and rotation in a second direction causes the removable electrical component to move away from the receptacle assembly.

13. The device of claim 12, wherein the removable electrical component is a printed circuit board.

14. The device of claim 12, further comprising:

a spring surrounding a portion of the drive shaft; and a detent located at a terminus of the first helical groove to receive the pin, wherein rotation of the drive shaft in the first direction compresses the spring and guides the pin to enter the detent.

15. The device of claim 12, wherein the first enlarged entry includes a first inclined entry guide.

16. The device of claim 15, wherein the first enlarged entry includes a second inclined entry guide, and further wherein the first inclined entry guide and the second inclined entry guide taper toward one another.

17. The device of claim 16, wherein the first inclined entry guide and the second inclined entry guide are formed from a first groove point and a second groove point.

18. The device of claim 16, further comprising a second helical groove having a second enlarged entry.

19. The device of claim 18, wherein the second enlarged entry includes a third inclined entry guide.

20. The device of claim 19, wherein the second enlarged entry includes a fourth inclined entry guide, and further wherein the third inclined entry guide and the fourth inclined entry guide taper toward one another.

21. The device of claim 20, wherein the third inclined entry guide and the fourth inclined entry guide are formed from the first groove point and the second groove point.

22. The device of claim 12, further comprising:

a locking member located within the handle; and a locking mechanism configured to receive the locking member and prevent rotation of the handle.

23. The device of claim 22, wherein the locking mechanism is a threaded member and the locking mechanism is a threaded connector.

24. A method comprising:

inserting a first tip of a first drive shaft attached to a printed circuit board into a first receptacle assembly attached to a device so that a first helical groove on the first drive shaft aligns with a first pin located within the first receptacle assembly;

inserting a second tip of a second drive shaft attached to the printed circuit board into a second receptacle assembly attached to the device so that a second helical groove on the second drive shaft aligns with a second pin located within the second receptacle assembly; and rotating a first handle coupled with the first drive shaft and a second handle coupled to the second drive shaft in a first direction to rotate the first drive shaft and the second drive shaft and thereby move the printed circuit board toward the device.

25. The method of claim 24, further comprising rotating the first handle and the second handle in a second direction to extract the printed circuit board from the device.

26. The method of claim 24, further comprising securing the first handle relative to the first receptacle assembly to prevent rotation of the first handle.

27. The method of claim 24, wherein a rotation of the first handle and the second handle couples the printed circuit board to a socket within the device.

28. An insertion and extraction device comprising:

a drive shaft having a helical groove;

means for coupling the drive shaft to a removable electrical component to assist in the insertion and extraction of the removable electrical component from an electrical device;

means for aligning the drive shaft with a fixed receptacle assembly of the electrical device; and means for moving the removable electrical component along a linear path due to rotation of the drive shaft.

29. The device of claim 28, further comprising means for indicating that the drive shaft has fully entered the receptacle assembly.

30. The device of claim 28, further comprising means for securing a handle coupled with the drive shaft relative to the receptacle assembly.

31. The system of claim 1, wherein the housing comprises a housing for an electrical device and the removable electrical component comprises a printed circuit board, the rotatable drive shaft is mounted to the printed circuit board for assisting in the insertion and extraction of printed circuit board from the electrical device, and the assembly is mounted to the housing of the electrical device to engage the drive shaft and urge the printed circuit board linearly into the network device.

32. The system of claim 31, wherein the drive shaft has a proximal end having a handle for rotation of the drive shaft and a distal end along which the first helical groove is disposed, rotation of the drive shaft in a first direction causes the proximal end to move toward the assembly to urge the printed circuit board linearly into the electrical device, and rotation of the drive shaft in a second direction causes the proximal end to move away from the assembly to urge the printed circuit board linearly away from the electrical device.

33. The system of claim 32, wherein the assembly coupled to the housing includes a first throughbore and the pin of the assembly is disposed within the throughbore, and the throughbore receives the distal end of the drive shaft coupled to the printed circuit board, and aligns the pin with the first helical groove of the drive shaft so that rotation of the handle causes rotation of the drive shaft and urges the pin to travel along the first helical groove.

34. A system comprising:

a printed circuit board;

a housing for an electrical device that receives the printed circuit board;

an assembly mounted to the housing, the assembly including a pin; and a rotatable drive shaft mounted to the printed circuit board to engage the assembly and assist in the insertion and extraction of the printed circuit board, wherein the drive shaft includes a first helical groove to receive the pin and guide the pin along the drive shaft and urge the printed circuit board linearly into the electrical device.

35. The system of claim 34, wherein the drive shaft has a proximal end having a handle for rotation of the drive shaft and a distal end along which the first helical groove is disposed, rotation of the drive shaft in a first direction causes the proximal end to move toward the assembly to urge the printed circuit board linearly into the electrical device, and rotation of the drive shaft in a second direction causes the proximal end to move away from the assembly to urge the printed circuit board linearly away from the electrical device.

36. The system of claim 35, wherein the assembly coupled to the housing includes a first throughbore and the pin of the assembly is disposed within the throughbore, and the throughbore receives the distal end of the drive shaft coupled to the printed circuit board, and aligns the pin with the first helical groove of the drive shaft so that rotation of the handle causes rotation of the drive shaft and urges the pin to travel along the first helical groove.

* * * * *

UNITED STATES PATENT AND TRADEMARK OFFICE

CERTIFICATE OF CORRECTION

PATENT NO. : 6,904,655 B1
DATED : June 14, 2005
INVENTOR(S) : David Lima et al.

It is certified that error appears in the above-identified patent and that said Letters Patent is hereby corrected as shown below:

Title page,
Item [75], Inventors, should read -- Tony Joseph Lillios -- rather than "Tony Joseph Lilios".

Signed and Sealed this

Thirtieth Day of August, 2005

JON W. DUDAS
*Director of the United States Patent and Trademark Office*